US010612254B2

(12) United States Patent
Waltz et al.

(10) Patent No.: US 10,612,254 B2
(45) Date of Patent: Apr. 7, 2020

(54) SYSTEMS AND METHODS FOR WALL SUPPORT AND/OR STRAIGHTENING

(71) Applicant: Supportworks, Inc., Omaha, NE (US)

(72) Inventors: John Edward Waltz, Omaha, NE (US); Kyle Olson, Omaha, NE (US)

(73) Assignee: SUPPORTWORKS, INC., Omaha, NE (US)

( * ) Notice: Subject to any disclaimer, the term of this patent is extended or adjusted under 35 U.S.C. 154(b) by 0 days.

(21) Appl. No.: 15/907,197

(22) Filed: Feb. 27, 2018

(65) Prior Publication Data

US 2018/0245361 A1 Aug. 30, 2018

Related U.S. Application Data

(60) Provisional application No. 62/464,802, filed on Feb. 28, 2017.

(51) Int. Cl.

| | |
|---|---|
| ***E04G 23/02*** | (2006.01) |
| ***E02D 37/00*** | (2006.01) |
| ***E02D 17/08*** | (2006.01) |
| ***E02D 5/08*** | (2006.01) |

(52) U.S. Cl.

CPC ..... *E04G 23/0229* (2013.01); *E02D 5/08* (2013.01); *E02D 17/08* (2013.01); *E02D 37/00* (2013.01); *E02D 2600/30* (2013.01)

(58) Field of Classification Search

CPC ..... E02D 17/00; E02D 17/08; E02D 29/02; E02D 29/0216; E02D 5/08; E02D 37/00; E02D 2600/30; E04G 23/0229

USPC .... 248/200, 220.21, 220.22, 222.13, 222.52, 248/222.51, 228.2, 231.31, 354.3; 405/284, 272; 52/514, 291, 293.2, 127.1, 52/127.2, 127.11, 127.12, 223.13, 293.3

See application file for complete search history.

(56) References Cited

U.S. PATENT DOCUMENTS

| | | | | |
|---|---|---|---|---|
| 377,940 | A | 2/1888 | Johnson | |
| 587,274 | A | 7/1897 | Rue | |
| 1,346,736 | A * | 7/1920 | Allee | E06B 3/984 403/231 |
| 2,319,303 | A * | 5/1943 | Crawford | E04F 21/0007 52/291 |
| 2,684,824 | A | 7/1954 | Hillberg | |
| 2,786,242 | A * | 3/1957 | Stephens | E04F 21/0007 52/291 |
| 2,850,254 | A | 9/1958 | Houseworth | |
| 2,914,147 | A | 11/1959 | Millard | |

(Continued)

FOREIGN PATENT DOCUMENTS

| | | |
|---|---|---|
| GB | 2199071 | 6/1988 |
| JP | 7197526 | 8/1995 |

(Continued)

OTHER PUBLICATIONS

Beams—Foundation Repair, Hydro Armor, https://www.youtube.com/watch?v=zpHwINImQv8, found Dec. 22, 2016, 1 page.

(Continued)

*Primary Examiner* — Robert Canfield
*Assistant Examiner* — Matthew J Gitlin
(74) *Attorney, Agent, or Firm* — Suiter Swantz pc llo

(57) ABSTRACT

System and methods for supporting and/or straightening a building wall are provided. The systems and methods utilize a pivot bracket.

18 Claims, 15 Drawing Sheets

(56) References Cited

U.S. PATENT DOCUMENTS 2,982,321 A * 5/1961 Hancock ..... E04F 21/0007 144/269
2,986,246 A * 5/1961 Lester ..... E04B 5/10 52/223.8
3,030,061 A 4/1962 Jennings
3,095,666 A 7/1963 Killen
3,147,570 A 9/1964 Shanton
3,304,672 A 2/1967 Bakke
3,341,995 A 9/1967 Docken
3,537,093 A 10/1970 Perret
3,537,220 A 11/1970 Ellis
3,817,006 A 6/1974 Williams
3,850,193 A 11/1974 Guzzo
3,874,625 A 4/1975 Hansen
4,021,905 A 5/1977 Benton
4,048,771 A 9/1977 Thistlethwaite
4,068,427 A 1/1978 Camardo
4,075,800 A 2/1978 Molick
4,083,156 A 4/1978 Tye
4,189,891 A 2/1980 Johnson
4,268,066 A 5/1981 Davis
4,288,899 A 9/1981 Mckee
4,304,078 A 12/1981 Meriwether, Jr.
4,353,194 A 10/1982 Norton
4,365,451 A 12/1982 Nelson
4,408,429 A * 10/1983 Neal ..... E04G 23/0207 52/514
4,435,646 A 3/1984 Coleman
4,452,019 A 6/1984 Ikuo
4,452,028 A 6/1984 Norton
4,465,648 A 8/1984 Kiriyama
4,472,883 A 9/1984 Ortega
4,563,852 A 1/1986 Achtenberg
4,575,980 A * 3/1986 Shuler ..... E04F 21/0007 52/222
4,669,704 A 6/1987 Abraham
4,752,214 A 6/1988 Justus
4,757,651 A 7/1988 Crites
4,763,878 A 8/1988 Abraham
4,872,634 A 10/1989 Gillaspy
4,888,926 A * 12/1989 Lutz, III ..... E04B 5/12 52/291
4,893,784 A 1/1990 Abraham
4,895,335 A 1/1990 Oliver
4,930,285 A 6/1990 Ward
4,937,989 A 7/1990 Miyares
4,970,835 A 11/1990 Harmon
5,048,243 A 9/1991 Ward
5,048,796 A 9/1991 Maldonado
5,120,162 A 6/1992 Parker
5,154,539 A 10/1992 Mccown, Sr.
5,234,287 A 8/1993 Rippe, Jr.
5,246,311 A 9/1993 West
5,277,003 A 1/1994 Myers
5,399,055 A 3/1995 Dutton, Jr.
5,401,120 A 3/1995 Hussey
5,433,556 A 7/1995 Freeman, III
5,496,081 A 3/1996 Rice
5,535,556 A 7/1996 Hughes, Jr.
5,564,242 A 10/1996 Larsen
5,575,591 A 11/1996 Vanderklaauw
5,586,355 A 12/1996 Metz
5,586,416 A 12/1996 Hess, III
5,620,038 A 4/1997 Decola
5,653,077 A 8/1997 Carnicello
5,694,723 A 12/1997 Parker
5,771,643 A 6/1998 Parker
5,794,393 A 8/1998 Fearn
5,797,227 A 8/1998 Garza Tamez
5,806,274 A 9/1998 Wurtz
5,829,220 A 11/1998 Zumeta
5,845,450 A 12/1998 Larsen
5,857,300 A 1/1999 Gates
5,875,606 A 3/1999 Jensen
5,884,439 A 3/1999 Hess, III
5,890,334 A 4/1999 Hughes, Jr.
5,913,787 A 6/1999 Edwards
5,943,830 A 8/1999 Truitt
5,956,906 A 9/1999 Berich
5,970,664 A 10/1999 Janesky
5,974,755 A 11/1999 Pouwels
5,983,587 A 11/1999 Limonad
5,992,126 A 11/1999 Ashton
6,023,901 A 2/2000 Jensen
6,044,613 A 4/2000 Crafts
6,047,504 A * 4/2000 Dusenberry ..... E04B 1/2608 52/514
6,073,405 A 6/2000 Kasai
6,079,905 A 6/2000 Ruiz
6,112,475 A 9/2000 Truitt
6,141,932 A 11/2000 Tarrant
6,142,710 A 11/2000 Holland, Jr.
6,145,260 A 11/2000 Morton
6,173,809 B1 1/2001 Cole
6,193,442 B1 2/2001 May
6,230,448 B1 * 5/2001 Oliver ..... E04G 23/0218 248/200.1
6,230,468 B1 5/2001 Klaus
6,256,940 B1 7/2001 Mackarvich
6,269,606 B1 8/2001 Mccown
6,354,050 B1 3/2002 Pankoski
6,357,190 B1 3/2002 Florentine
6,389,766 B1 * 5/2002 Jackson ..... E04C 3/18 52/223.11
6,416,254 B1 7/2002 Carlson
6,418,684 B1 7/2002 Morton
6,450,480 B2 9/2002 Massile
6,460,305 B1 10/2002 Vanhaitsma
6,484,460 B2 11/2002 Vanhaitsma
6,539,677 B1 4/2003 Lanka
6,632,048 B2 10/2003 Greenberg
6,662,505 B2 12/2003 Heady
6,676,335 B1 1/2004 Hickman
6,692,595 B2 2/2004 Wheatley
6,698,710 B1 3/2004 Vanderwerf
6,746,741 B2 6/2004 Wheatley
6,763,636 B2 7/2004 Dimitrijevic
6,767,167 B1 7/2004 Rials
6,769,222 B2 8/2004 Billante
6,846,537 B2 1/2005 Wheatley
6,877,284 B2 4/2005 Thompson
6,931,805 B2 8/2005 Gregory
7,117,648 B1 10/2006 Pryor
RE39,839 E 9/2007 Wheatley
7,380,372 B2 6/2008 Resch
7,407,004 B2 8/2008 Kugemoto
7,419,335 B1 9/2008 Cohen
7,478,508 B2 1/2009 Peterson
7,681,361 B1 3/2010 Jendusa
7,681,367 B2 3/2010 Morton
7,721,488 B1 5/2010 Bennett
7,726,093 B2 6/2010 Morton
7,735,268 B1 6/2010 Zidar
7,743,585 B2 6/2010 Wheatley
7,765,764 B2 8/2010 Zambelli
7,774,995 B1 8/2010 Zidar, Jr.
7,788,859 B2 9/2010 Trotter
7,823,354 B2 11/2010 Wheatley
7,861,469 B2 1/2011 Heady
8,136,317 B1 3/2012 Mccown
8,142,102 B2 3/2012 Wheatley
8,201,380 B2 6/2012 Hargest
8,209,935 B2 7/2012 Heady
8,312,682 B2 11/2012 Trotter
8,367,569 B2 2/2013 Wheatley
8,584,431 B2 * 11/2013 Secrest ..... E02D 29/00 52/293.2
8,590,213 B2 11/2013 Scarfo
8,590,259 B2 11/2013 Trinko
8,607,525 B2 12/2013 Trotter
8,720,154 B1 5/2014 Horne
8,820,013 B2 9/2014 Fennell
8,925,267 B1 1/2015 Kirby

(56) References Cited

U.S. PATENT DOCUMENTS

| | | | | |
|---|---|---|---|---|
| 9,034,775 | B2 | 5/2015 | Wheatley | |
| 9,091,090 | B1 | 7/2015 | Kirby | |
| 9,194,126 | B2 | 11/2015 | Gill | |
| 9,222,252 | B1 | 12/2015 | Williams | |
| 9,422,734 | B1 | 8/2016 | Heady | |
| 9,909,278 | B2 * | 3/2018 | Morton | E04B 2/02 |
| 2002/0062612 | A1 | 5/2002 | Heady | |
| 2003/0131543 | A1 | 7/2003 | Hansort | |
| 2003/0131555 | A1 | 7/2003 | Heady | |
| 2003/0192280 | A1 | 10/2003 | Billante | |
| 2004/0105727 | A1 | 6/2004 | Jones | |
| 2005/0086889 | A1 | 4/2005 | Shock | |
| 2005/0138870 | A1 | 6/2005 | Ishimura | |
| 2005/0204673 | A1 | 9/2005 | Reed | |
| 2006/0080926 | A1 | 4/2006 | Resch | |
| 2006/0137278 | A1 | 6/2006 | Heady | |
| 2007/0227082 | A1 | 10/2007 | Morton | |
| 2007/0272353 | A1 | 11/2007 | Wheatley | |
| 2009/0057518 | A1 | 3/2009 | Russell | |
| 2009/0071085 | A1 | 3/2009 | Wheatley | |
| 2009/0071096 | A1 | 3/2009 | Morton | |
| 2009/0078843 | A1 | 3/2009 | Trotter | |
| 2009/0193736 | A1 | 8/2009 | Halfon | |
| 2009/0263572 | A1 | 10/2009 | Wheatley | |
| 2010/0095603 | A1 | 4/2010 | Defilipp | |
| 2011/0232207 | A1 | 9/2011 | Duke | |
| 2012/0204512 | A1 | 8/2012 | Trinko | |
| 2015/0204092 | A1 * | 7/2015 | Crumley | E04G 23/0229 52/514 |
| 2015/0267424 | A1 * | 9/2015 | Reisdorff | E04C 3/30 52/514 |
| 2016/0153207 | A1 | 6/2016 | Ozum | |

FOREIGN PATENT DOCUMENTS

| | | |
|---|---|---|
| JP | 10168970 | 6/1998 |
| JP | 11256726 | 9/1999 |
| WO | 199635023 | 11/1996 |
| WO | 2001042572 | 6/2001 |
| WO | 2002053844 | 7/2002 |
| WO | 2008048619 | 3/2008 |

OTHER PUBLICATIONS

Foundation Repair, U.S. Waterproofing, http://www.uswaterproofing.com/services/structural-foundation-repair, found Dec. 22, 2016, 4 pages.

Foundation Repair, BQ Basement Systems, https://www.bqbasementsystems.com/foundation-repair.html, found Dec. 22, 2016, 7 pages.

Greenbaum, The Force Wall Stabilizer, The Basement Doctor, https://www.mybasementdoctor.com/products/foundation-repair/the-force-wall-stabilizer.html, found Dec. 22, 2016, 6 pages.

Iyer, Smart Jack Support System, Ayers Basement System, https://www.ayersbasementsystems.com/foundation-repair/photo-gallery/3631-album-foundation-stabilization-in-fremont-mi.html%20-%20ad-image-2, found Dec. 22, 2016, 5 pages.

Johnson et al., Securing the Floor Joist Hardware, Innovative Basement Systems, https://www.innovativebasementsystems.com/foundation-repair/foundation-repair-products/wall-repair-system.html, found Dec. 22, 2016, 11 pages.

Straightening Cracked and Bowed Basement Walls, Master Dry, https://www.masterdry.com/foundation-repair/foundation-repair-services/wall-straightening.html, found Dec. 22, 2016, 5 pages.

Wall Bracing, Pankey Foundation Repair, http://www.pankeyfoundation.com/wall-bracing.html, found Dec. 22, 2016, 1 page.

Wall Repair System, Foundation Specialties, Inc., https://www.foundationspecialties.com/foundation-repair-products/wall-repair-system.html, found Dec. 22, 2016, 7 pages.

Wall Straightening, Dry-Mich, https://www.drymich.com/foundation-repair/foundation-services/wall-straightening.html, found Dec. 22, 2016, 8 pages.

* cited by examiner 100
152
130
110
108
138
120
124
116
114
115
112
102
OVER TIME STRAIGHTENS WALL
104
128
126
106
150
118
114

102
100
152
130
110
108
138
120
124
116
114
115
TIGHTEN SCREW
112
104
BEAM APPLIES LOAD TO WALL AT CRACK
128
126
106
150
118
114

102
100
152
130
110
108
138
120
116
124
114
115
PIVOT BRACKET W/ JACK SCREW
112
104
CRACK
128
126
106
FIXED BASE
150
118
114

SYSTEMS AND METHODS FOR WALL SUPPORT AND/OR STRAIGHTENING

CROSS-REFERENCE TO RELATED APPLICATIONS

This application claims the benefit of and priority to U.S. provisional patent application Ser. No. 64/464,802, filed Feb. 28, 2017, and entitled "SYSTEMS AND METHODS FOR WALL SUPPORT AND/OR STRAIGHTENING," which application is incorporated herein by reference in its entirety.

INTRODUCTION

Building walls, such as foundation walls below grade, are subjected to external forces from soil, hydrostatic pressures, and/or plant root system growth. These forces or pressures can cause foundation walls to bow or lean. In some instances, these forces are applied on plots where there is only a small distance from the wall at issue and another adjacent structure, environmental obstacles, or a given property line.

It is with respect to these and other general considerations that aspects disclosed herein have been made. Also, although relatively specific problems may be discussed, it should be understood that the aspects should not be limited to solving the specific problems identified in the background or elsewhere in this disclosure.

SUMMARY

In summary, the disclosure generally relates to systems and methods for supporting and/or straightening a building wall. The systems and methods as disclosed herein utilize a pivot bracket and/or a plate. The systems and methods as disclosed herein apply a compression load to a floor support structure during the supporting and/or straightening of a wall.

In one aspect, the disclosure is directed to a support system. The support system includes a beam, a pivot bracket, a force application mechanism, and a plate. The beam has a first end and a second end. The beam is configured to support a building wall located between a first floor and a second floor. The first end of the beam is configured to couple to the first floor. The pivot bracket includes a cam surface and a rotational coupling. The pivot bracket is configured to pivotably couple to a floor support structure of the second floor utilizing the rotational coupling. The force application mechanism interacts with the pivot bracket and engages the second end of the beam. The plate is configured to couple to the floor support structure of the second floor and is positioned to mechanically link with the cam surface of the pivot bracket.

In another aspect, the disclosure is directed to a method for supporting and/or straightening a building wall. The method includes:

aligning a beam with a first end and a second end along the building wall between a first floor and a second floor;

coupling the first end of the beam to the first floor;

coupling a pivot bracket including a cam surface and a rotation coupling to a floor support structure of the second floor utilizing the rotation coupling;

positioning a plate to mechanically link with the cam surface of the pivot bracket to form a positioned plate;

coupling the positioned plate to the floor support structure of the second floor;

positioning a force application mechanism to interact with the pivot bracket and to engage the second end of the beam; and actuating the force application mechanism to apply a force to the second end of the beam.

In yet another aspect, the disclosure is directed to a support system. The support system includes a bean, a pivot bracket, a force application mechanism, and a plate. The beam has a first end and a second end. The pivot bracket includes a receptacle, a cam surface, and a rotational coupling. The force application mechanism is placed through the receptacle of the pivot bracket until the force application mechanism engages with the second end of the beam. The plate is positioned to mechanically link with the cam surface of the pivot bracket.

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

These and other features and advantages will be apparent from a reading of the following detailed description and a review of the associated drawings. It is to be understood that both the foregoing general description and the following detailed description are illustrative only and are not restrictive of the claims.

BRIEF DESCRIPTION OF THE DRAWINGS

Non-limiting and non-exhaustive examples or aspects are described with reference to the following Figures.

DETAILED DESCRIPTION

As discussed above, forces from soil, hydrostatic pressures, and/or plant root systems can cause a foundation wall below grade to bow or lean. Several different types of systems are currently utilized to reinforce and straighten a wall that is bowing or leaning. Some systems utilize a beam or support vertically aligned along the bowed or leaning wall. In these systems, the beam is anchored or otherwise secured to the foundation and to the underside of the upper floor. However, these previously utilized systems provide flawed load transfer from the beam to the underside of the floor. For example, the previously utilized systems apply an eccentric load to the distribution member.

Therefore, the systems and methods disclosed herein support and/or straighten a leaning or bowed wall by applying a direct compression load to the distribution member. The systems and methods disclosed herein utilize a pivot bracket and/or a plate for a direct transfer of the load to the distribution member, which spreads the load to the rest of the floor structure.

In the following detailed description, references are made to the accompanying drawings that form a part hereof, and in which are shown by way of illustrations specific embodiments, aspects, or examples. These aspects or examples may be combined, other aspects or examples may be utilized, and structural changes may be made without departing from the spirit or scope of the present disclosure. The following detailed description is therefore not to be taken in a limiting sense, and the scope of the present disclosure is defined by the appended claims and their equivalents.

Figure 10:
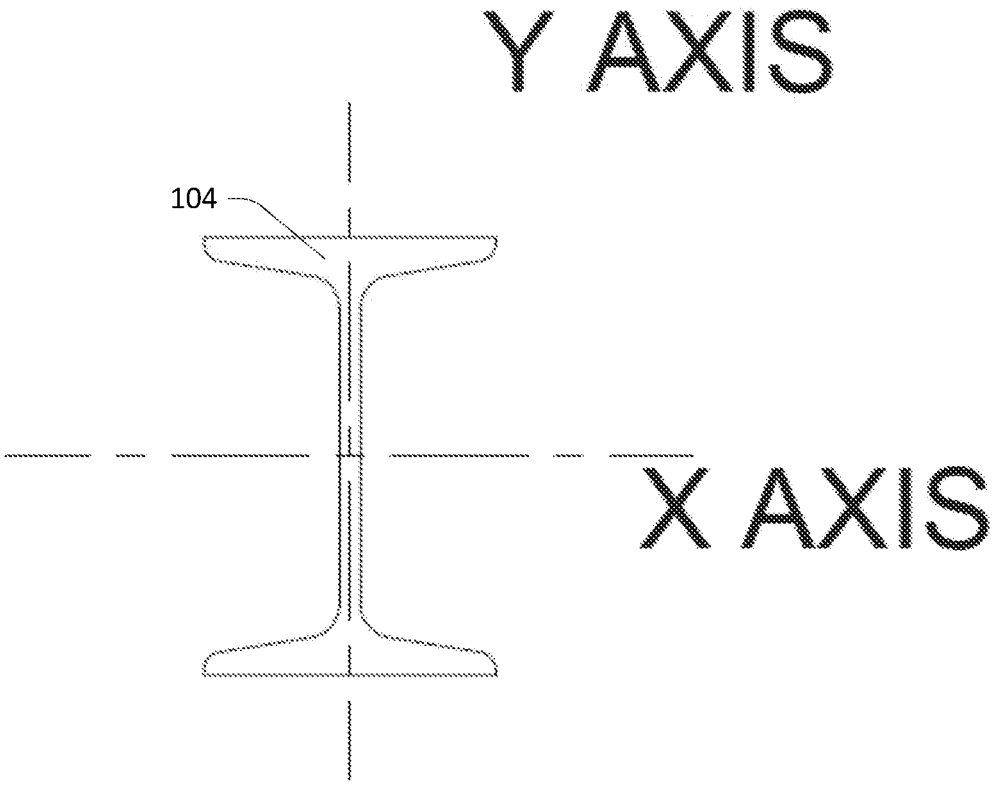
FIG. 10 is top view illustrating two different axes of the I-beam, in accordance with an aspect of the disclosure.

Referring now to the drawings, in which like numerals represent like elements through the several figures, various aspects of the disclosure will be described. FIGS. 1A-1C and 2A-2C are schematic diagrams illustrating a support system 100 for supporting and/or straightening a building wall 102, in accordance with an aspect of the disclosure. The support system 100 for supporting and/or straightening a building wall 102 includes a beam 104, a pivot bracket 108, a force application mechanism 112, and a plate 115. The beam may be made of one or more different materials, such as iron, steel, aluminum, etc., or any suitable material for supporting a bowing and/or leaning wall. The beam may be in any suitable size or shape for supporting a leaning and/or bowing wall, such as round, rectangular, square, triangular, etc. For example, the beam 104 may be a steel I-beam with a cross-section as illustrated in FIG. 10. FIG. 10 also illustrates two different axes of the I-beam.

In some aspects, the system 100 for supporting and/or straightening a building wall 102 also includes one or more block inserts 116, one or more attachment mechanisms 114, a holding bracket 110, and/or a base bracket 106. The building wall 102 runs between a first floor 118 and a second floor 120. The first floor 118 and/or the second floor 120 may include a floor support structure 122. The floor support structure may be on the underside of the first floor 118 and/or the second floor 120. In some aspects, the floor support structure 122 includes one or more joist 124. The floor support structure 122, such as floor joists 124, may run perpendicular or parallel to the bowed or leaning building wall 102 depending upon the second floor configuration. Accordingly, the floor support structure 122, such as floor joists 124, may run perpendicular or parallel to the Y-axis of the beam 104 depending upon second floor configuration.

In some aspects, the building wall 102 starts at a top side of a first floor 118 and runs to the floor support structure 122 of a second floor 120. However, this configuration is exemplary only and is not meant to be limiting. The building wall 102 may be configured to run from any portion of a first floor 118 to any portion of a second floor 120. In some aspects, the building wall 102 is a foundation wall that is below grade as illustrated in FIGS. 1A-1C and 2A-2C. As such, in these aspects, earth 130 and/or soil 130 is located on the exterior side 126 of the building wall 102. The beam 104 is positioned next to the interior side 128 of a leaning or bowing building wall 102. In some aspects, the building wall 102 bows or leans due to external forces pushing against the building wall 102 and causes a crack to form in the building wall 102.

The support system 100 prevents any further inward bowing and/or leaning of building wall 102. In some aspects, if conditions are favorable, the support system 100 will straighten a bowed and/or leaning wall 102 over time. For example, as the soil 130 exterior to the building wall 102 dries out or shrinks, the support system 100 will push the building wall 102 back into the area from where the expanded soil 130 had receded.

Figures 1A, 1B, 1C:
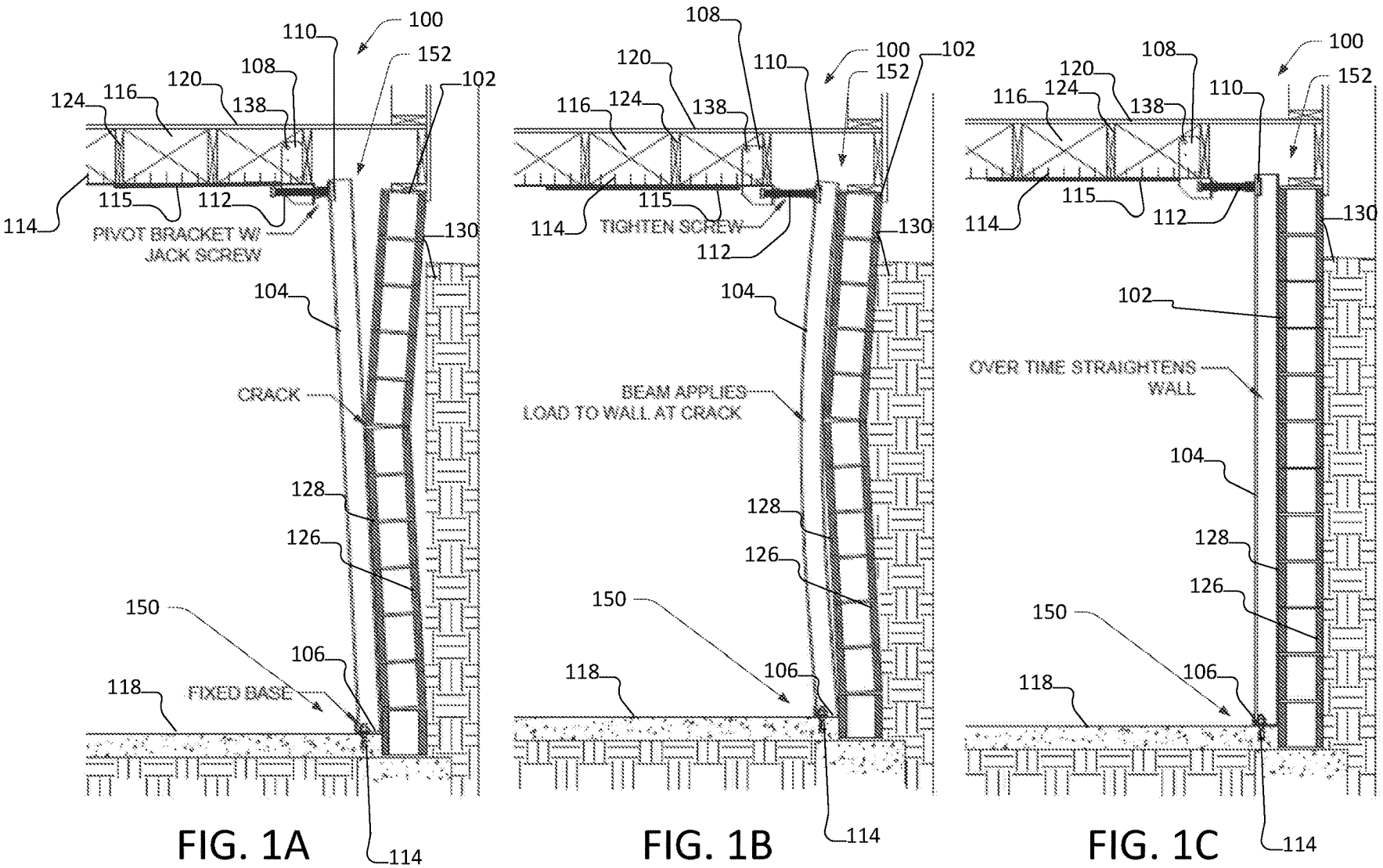
FIGS. 1A-1C are schematic diagrams illustrating a support system for supporting and/or straightening a building wall, in accordance with an aspect of the disclosure.
Figure 2C:
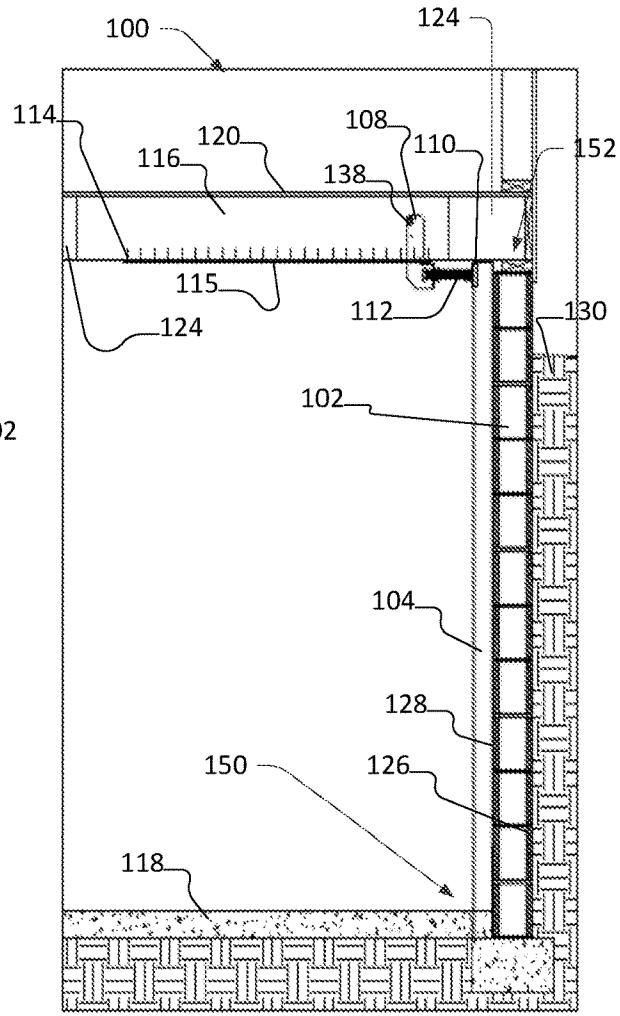
FIGS. 2A-2C are schematic diagrams illustrating a support system for supporting and/or straightening a building wall, in accordance with an aspect of the disclosure.
Figure 2B:
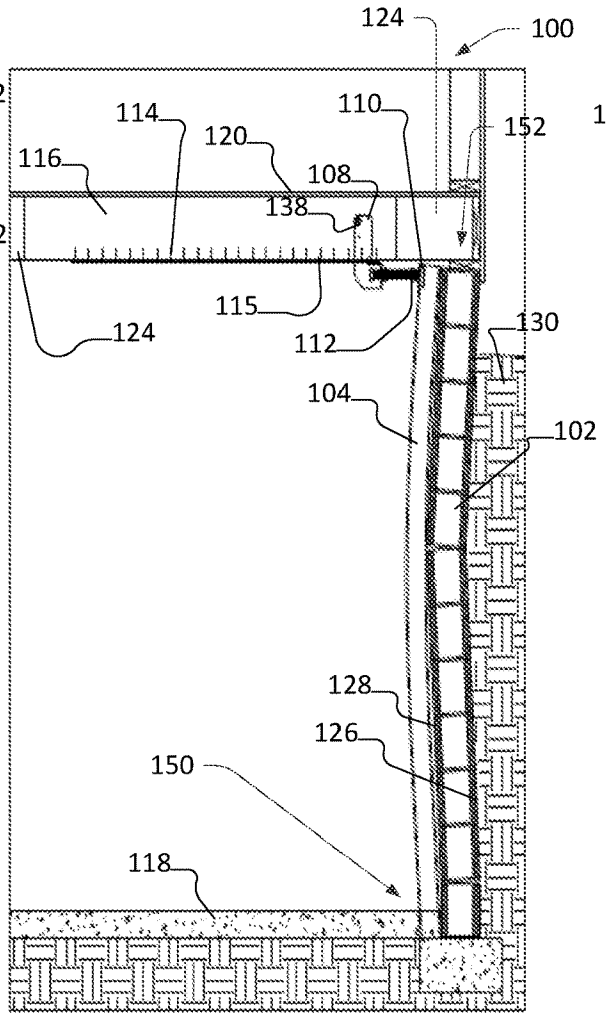
Figure 2A:
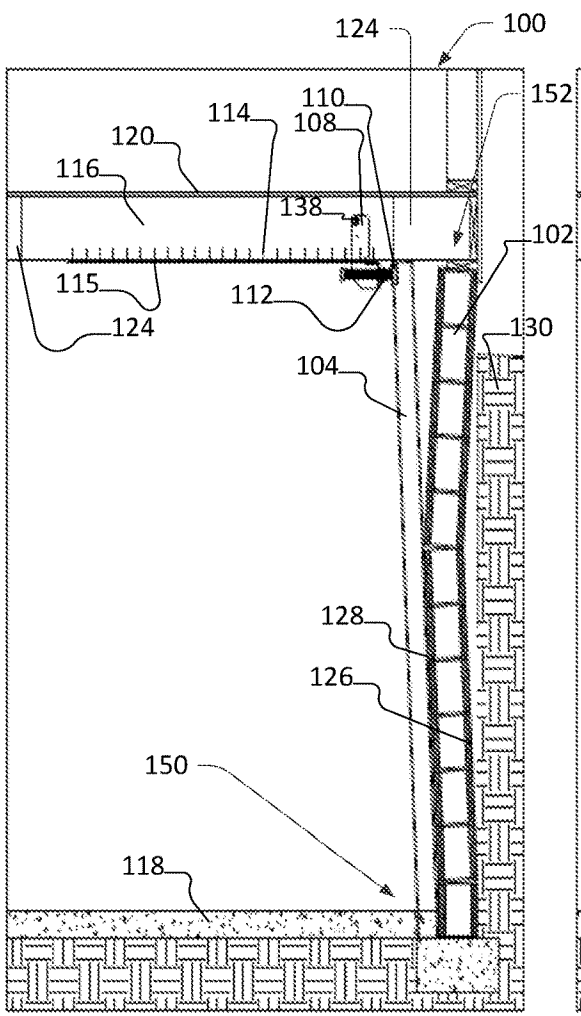

FIGS. 1A and 2A are schematic diagrams illustrating a support system 100 after an initial installation, in accordance with an aspect of the disclosure. FIGS. 1B and 2B are schematic diagrams illustrating the system 100 as shown in FIGS. 1A and 2A after the force application mechanism 112 has been tightened, extended, or positioned to apply a force to the beam 104, in accordance with an aspect of the disclosure. The force application mechanism 112 may be a jack, a compression pin, scissor jack, a wedge, a dowel, a bolt, a hydraulic pump, etc. This list is exemplary and is not meant to be limiting. The force application mechanism may be any physical structure utilized to apply a force on the support system 100. As discussed above, the beam 104 includes two ends, such a first end 150 and second end 152. Each end 150 and 152 is positioned at one of the floors 118 and 120 during installation of the support system 100. In some aspects, the force application mechanism 112, such as a bolt, is positioned to force an end 152 of the beam 104 up against or closer to the building wall 102. The beam 104 may be configured to support a building wall 102 located between a first floor 118 and second floor 120. The tightening, positioning, extension, and/or or rotation of the force application mechanism 112 causes the support system 100 to apply a constant load to the building wall 102. As discussed above, the constant load may be transferred by the support system 100 by direct force to the load distribution plate 115 then to the floor support structure of the second floor 120. FIGS. 1C and 2C are a schematic diagram illustrating the system 100 shown in FIGS. 1B and 2B after a predetermined amount of time has passed from the loading of the force application mechanism 112 to allow the support system 100 to straighten the building wall 102, in accordance with an aspect of the disclosure.

The first end 150 of the beam 104 is coupled to the first floor 118. In some aspects, the first end 150 is coupled to the first floor utilizing a base bracket 106 and an attachment mechanism 114 as illustrated in FIGS. 1A-1C. The term "couple" or "coupled" as utilized herein refers to a direct attachment of items or to an indirect attachment of to two items through an intermediate piece. An attachment mechanism 114 as utilized herein refers to any suitable system for attaching one component to another, such as welding, adhesive, bolts, screws, nails, pins, anchors, concrete, etc. As illustrated by FIGS. 1A-1C, the base bracket 106 may be welded to the beam 104, which is attached to the floor 118 utilizing a screw or bolt. In some aspects, the base bracket 106 is directly fixed or attached to an end 150 of the beam 104 and a floor 118. In other aspects, the base bracket 106 is in an integral part of the beam 104. In other aspects, the base bracket 106 is indirectly fixed or attached to an end 150 of the beam 104 and/or a floor 118.

In alternative aspects, the beam 104 is coupled to the first floor 118 by embedding the beam 104 into the first floor 118 as illustrated in FIGS. 2A-2C. The beam 104 may be embedding into the first floor 118 by inserting the first end 150 of the beam 104 into a hole in the first floor 118. The hole may be dug or created in the first floor 118 for the beam 104. In further aspects, the first end 150 of the beam 104 may be secured to the hole in the first floor 118 utilizing an attachment mechanism, such as bolts, concrete, welding, or asphalt. In other aspects, the end of the beam 104 is not secured to the first floor 118 and/or the hole and is instead just placed inside the hole. This list of couplings between the beam 104 and the first floor 118 is exemplary and is not meant to be limiting. As understood by a person of skill in the art, any suitable system or method for coupling the beam 104 to a floor 118 may be utilized herein.

The beam 104 is extended up or aligned with the wall 102. In some aspects, the beam 104 is extended as flush as can be given the bowed or leaning wall 102 as illustrated in FIGS. 1A and 2A. In some aspects, the second end 152 of the beam 104 is coupled to the second floor 120 and/or pivot bracket 108. In some aspects, the second end 152 of the beam 104 is coupled to the second floor 120 utilizing a holding bracket 110, a pivot bracket 108, and/or a force application mechanism 112. In other aspects, the second end 152 of the beam 104 is not coupled to the second floor 152, but instead interacts with or engages a force application mechanism 112. While these aspects show the first end 150 and the first floor 118 being on the bottom and the second floor 120 and second end 152 being on the top, the first floor 118 and/or the first end 150 may be on the top or bottom depending upon the configuration of the beam 104 and/or building. An attachment mechanism 114 may be utilized to attach the holding bracket 110 to the second end 152 of the beam 104. In other aspects, the holding bracket 110 is an integral part of the beam 104. In some aspects, the holding bracket 110 is directly attached to the beam 104. The holding bracket 110 may include a structure, such as a notch or bolt receptacle, for receiving an end of the force application mechanism 112. In some aspects, the structure is configured to receive an end of the force application mechanism 112, such as a bolt.

In other aspects, a holding bracket 110 is not utilized by the support system 100. In these aspects, the beam 104 utilizes another mechanism, such as an attachment mechanism 114, to couple to the second end of the beam 152 to the second floor 120. In alternative aspects, the second end of the beam may be embedded into the second floor 120. Further, in these aspects, the force application mechanism 112 may also couple to, engage, or mechanically engage with the second end 152 of the beam 104 utilizing any suitable mechanism, including no mechanism, as known by a person of skill in the art, such as a notch, a mechanical linkage, bolts, etc. As understood by a person of skill in the art, any suitable system or method for coupling the beam 104 to a floor 120 may be utilized herein. Alternatively, as discussed above, the second end 152 of the beam 104 is not coupled to the second floor 120.

Figure 11A:
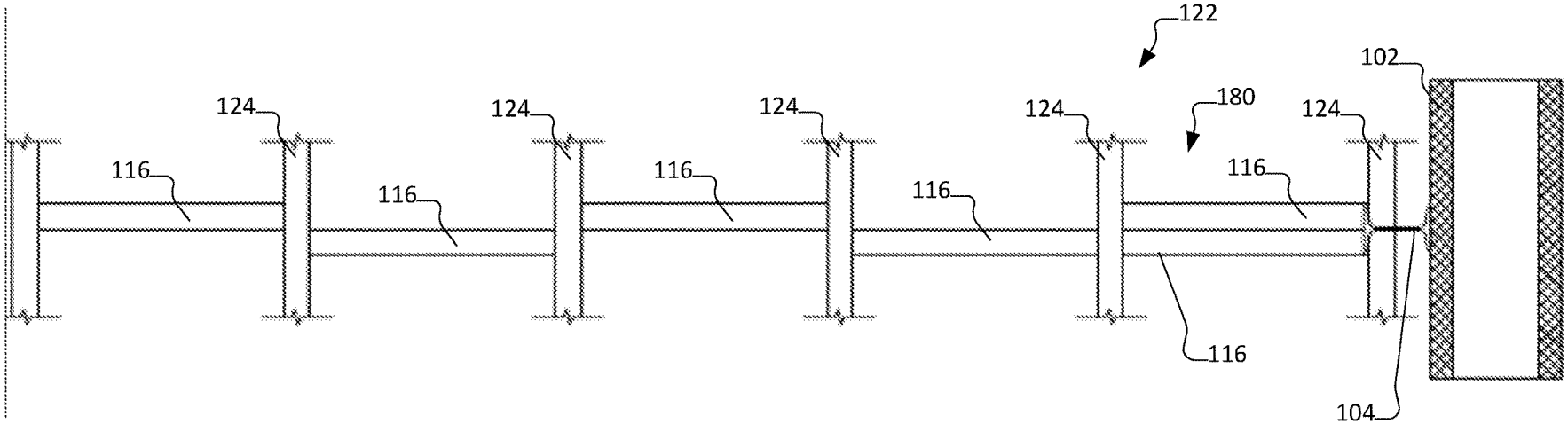
FIGS. 11A-11B are schematic diagrams illustrating partial, bottom views of a parallel joist floor support structure and a support system in different stages of installation, in accordance with aspects of disclosure.
Figure 11B:
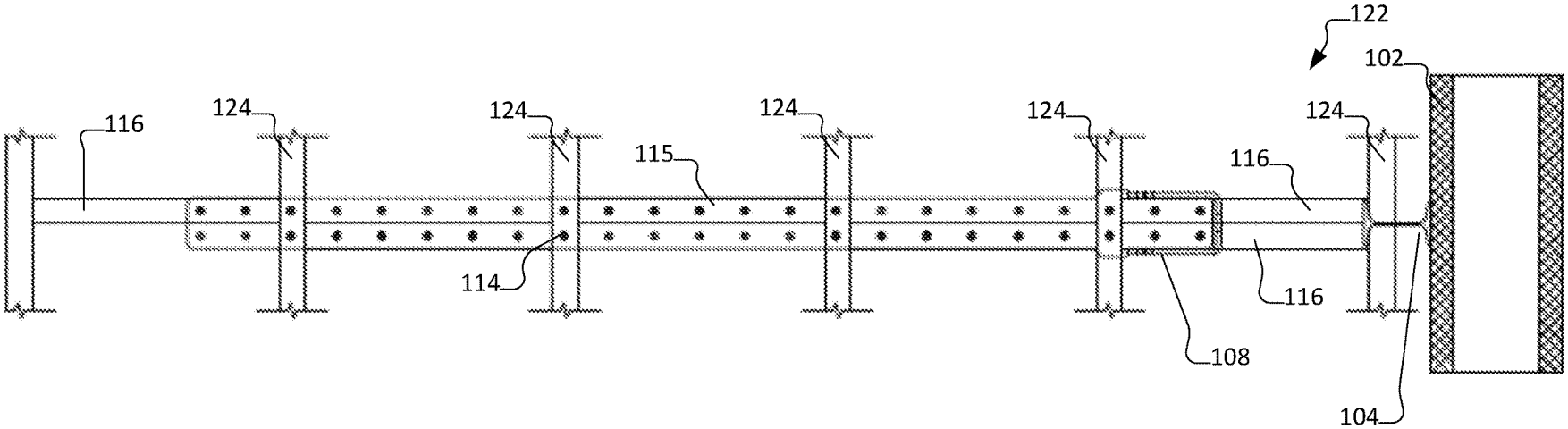
Figure 11C:
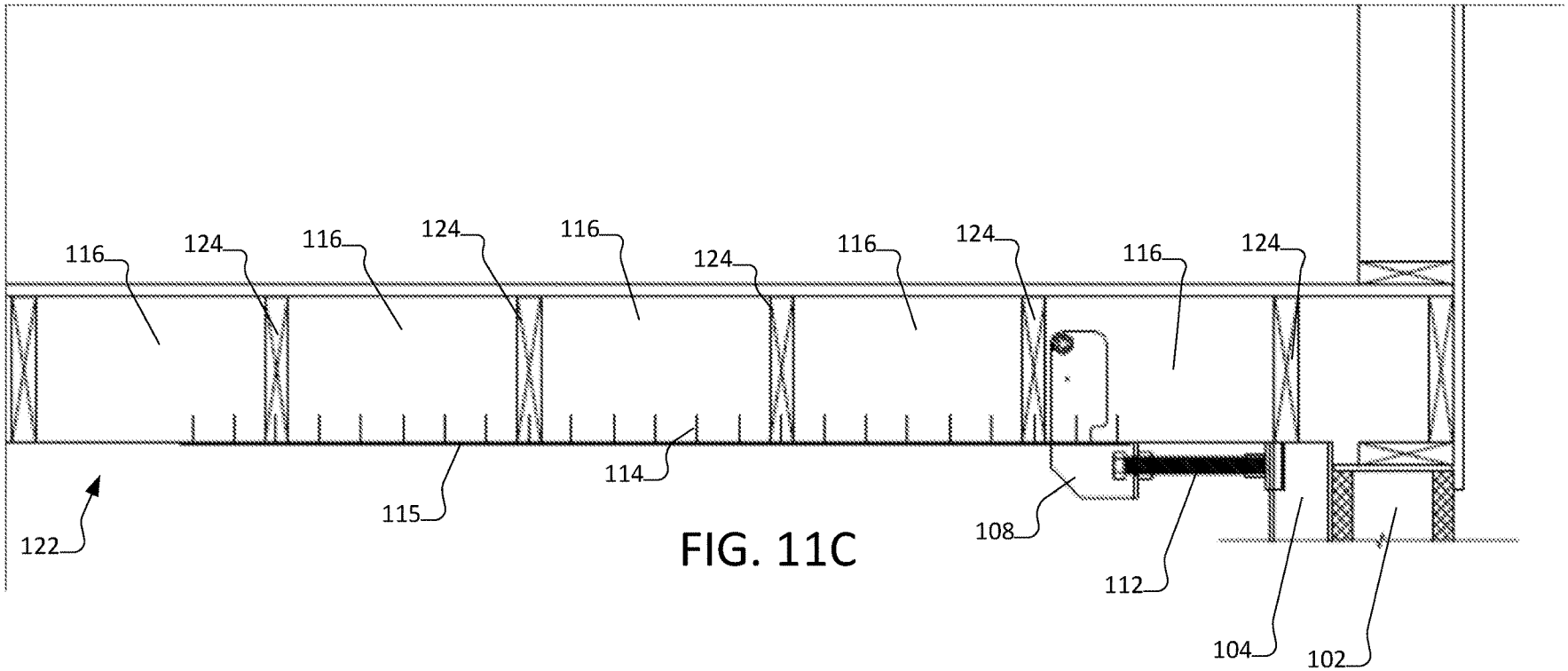
FIG. 11C is a schematic diagram illustrating a partial, side cross-sectional view of FIG. 11B, in accordance with aspects of the disclosure

As discussed above, the floor 120 includes a floor support structure 122, such as one or more joist 124 as illustrated by FIGS. 11A-12C. The configuration of the floor support structure 122 with respect to the leaning or bowed wall 102 may affect how the support system 100 is installed. For example, the floor support structure 122 may include one or more floor joist 124 that run parallel to the wall 102. FIGS. 11A-11B are schematic diagrams illustrating partial, bottom views of a parallel joist floor support structure and the support system in different stages of installation, in accordance with aspects of disclosure. FIG. 11C is a schematic diagram illustrating a partial, side cross-sectional view of FIG. 11B, in accordance with aspects of the disclosure. In this configuration, one or more block inserts 116 may be inserted between the first and second joists and then attached via an attachment mechanism 114 to the floor support structure 122, such as the first and second joists as illustrated in FIGS. 11A-11C. In these aspects, the one or more block inserts may extend from the first joist to the second joist or extend a portion of the length from the first floor joist to the second floor joist. In the example provided in FIGS. 11A-11C, a plurality of block inserts 116 run perpendicular to the wall 102. Accordingly, in this example, the plurality of block inserts 116 run perpendicular to the joists 124 and/or the floor support structure 122. For example, the replica block inserts 116 illustrated in FIGS. 4, 5A, 5B, and 7 would run perpendicular with the wall 102 if they were actually installed. Additionally, the block inserts 116 illustrated in FIG. 8 also run perpendicular to the wall 102.

Figure 12A:
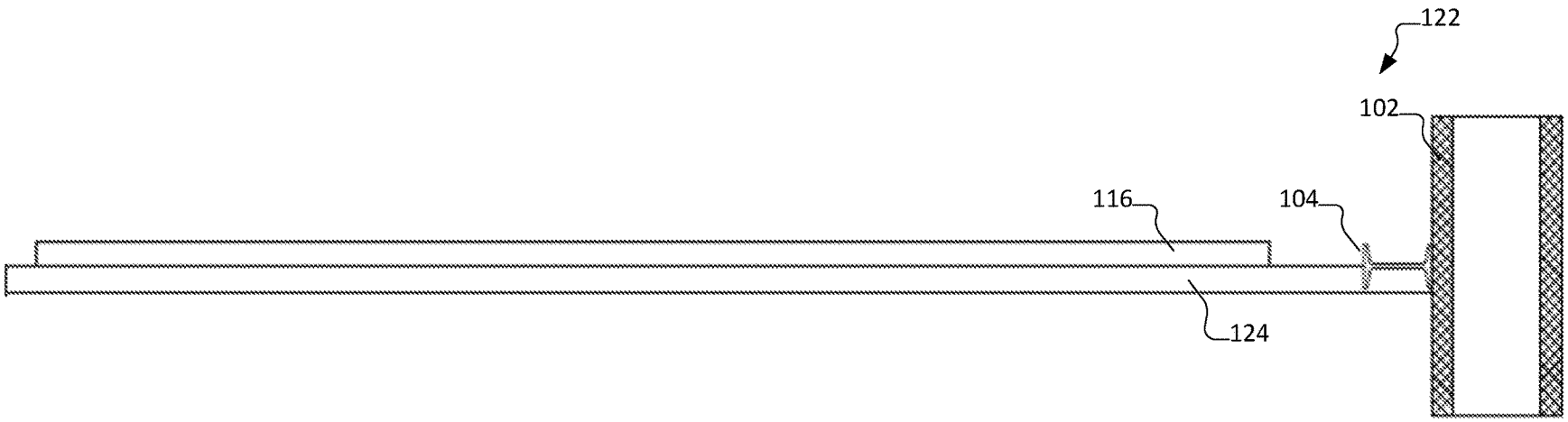
FIGS. 12A-12B are schematic diagrams illustrating partial, bottom views of a perpendicular joist support structure and a support system in different stages of installation, in accordance with aspects of the disclosure.
Figure 12B:
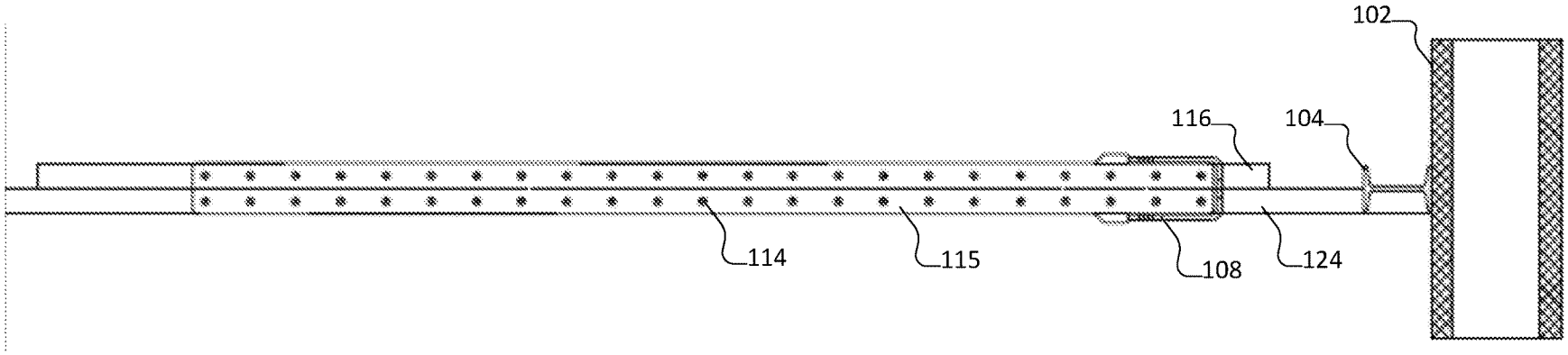
Figure 12C:
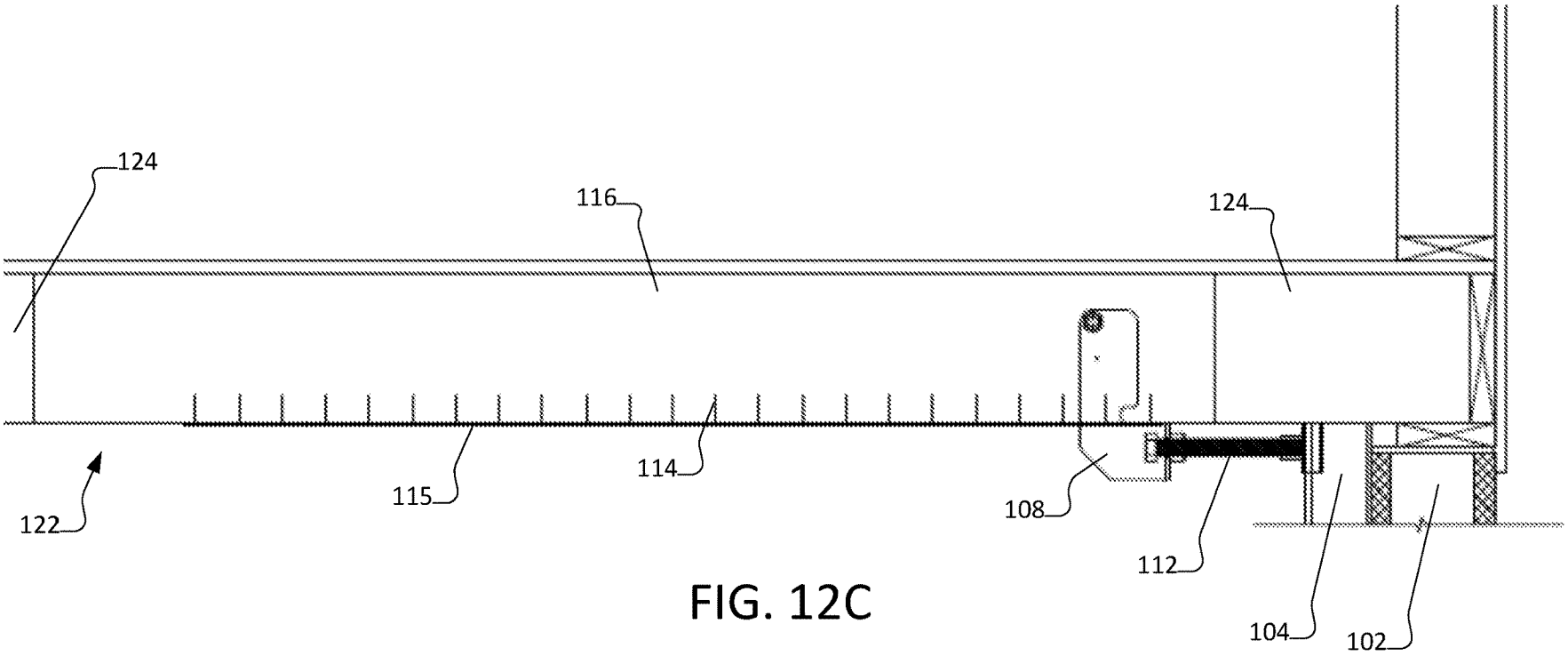
FIG. 12C is a schematic diagram illustrating a partial, side cross-sectional view of FIG. 12B, in accordance with aspects of the disclosure.

In other configurations, the floor support structure 122 may include one or more floor joist 124 that run perpendicular to the wall 102. FIGS. 12A-12B are schematic diagrams illustrating partial, bottom views of a perpendicular joist support structure and the support system in different stages of installation, in accordance with aspects of the disclosure. FIG. 12C is a schematic diagram illustrating a partial, side cross-sectional view of FIG. 12B, in accordance with aspects of the disclosure. In these aspects, one or more block inserts 116 may be inserted or installed adjacent to a first joist 124 and then attached via an attachment mechanism 114 to the floor support structure 122, such as the first joist as illustrated in FIGS. 12A-12C. In these aspects, the one or more block inserts may extend the length of the first floor joist or extend along a portion of the length of the first floor joist. In the example provided in FIGS. 12A-12C, a single block insert 116 runs perpendicular to the wall. Accordingly, in this example, the single block insert runs 116 run parallel to the joists 124 and/or the floor support structure 122.

The block inserts 116 may be utilized by the support system 100 to provide additional areas to attach the plate 115 and/or pivot bracket 108. In some aspects, the block inserts 116 may be utilized by the support system 100 to help provide load transfer from the beam 104 to the second floor 120. In some aspects, a block insert 116 may be a wood member. The wood member may be a wooden board, such as 2×4. These examples are not meant to be limiting. The block insert 116 may be made of any suitable material, size and/or shape for use with support system 100.

In further aspects, two block inserts 116 may be positioned side-by-side lengthwise to extend the distance between the first and second joists of the floor 120 as illustrated by reference number 180 in FIG. 11A. In alternative aspects, block inserts 116 are not utilized by the support system 100.

Figure 3A:
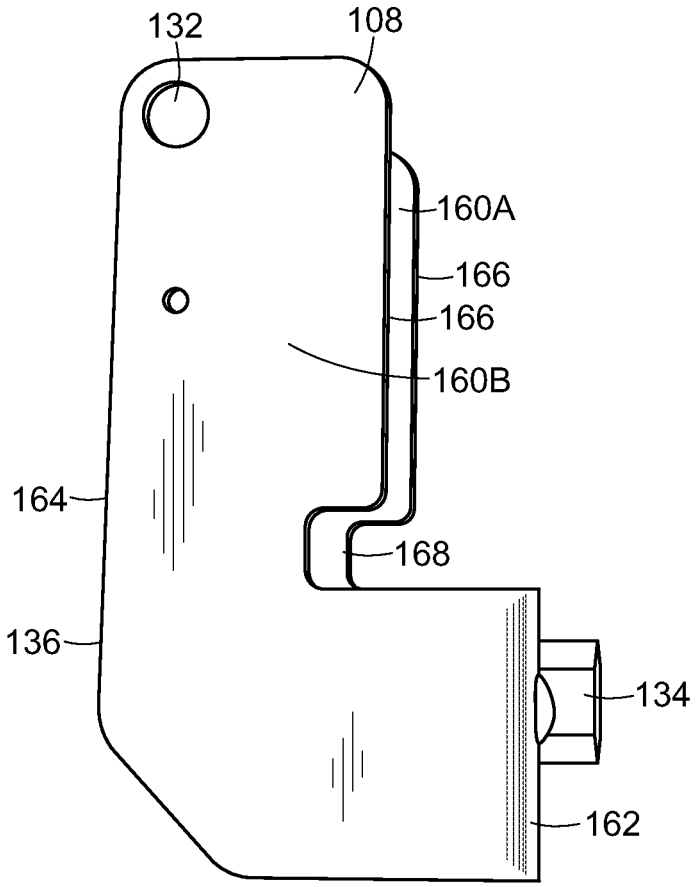
FIG. 3A is a side view illustrating a pivot bracket of the support system, in accordance with an aspect of the disclosure.
Figure 3B:
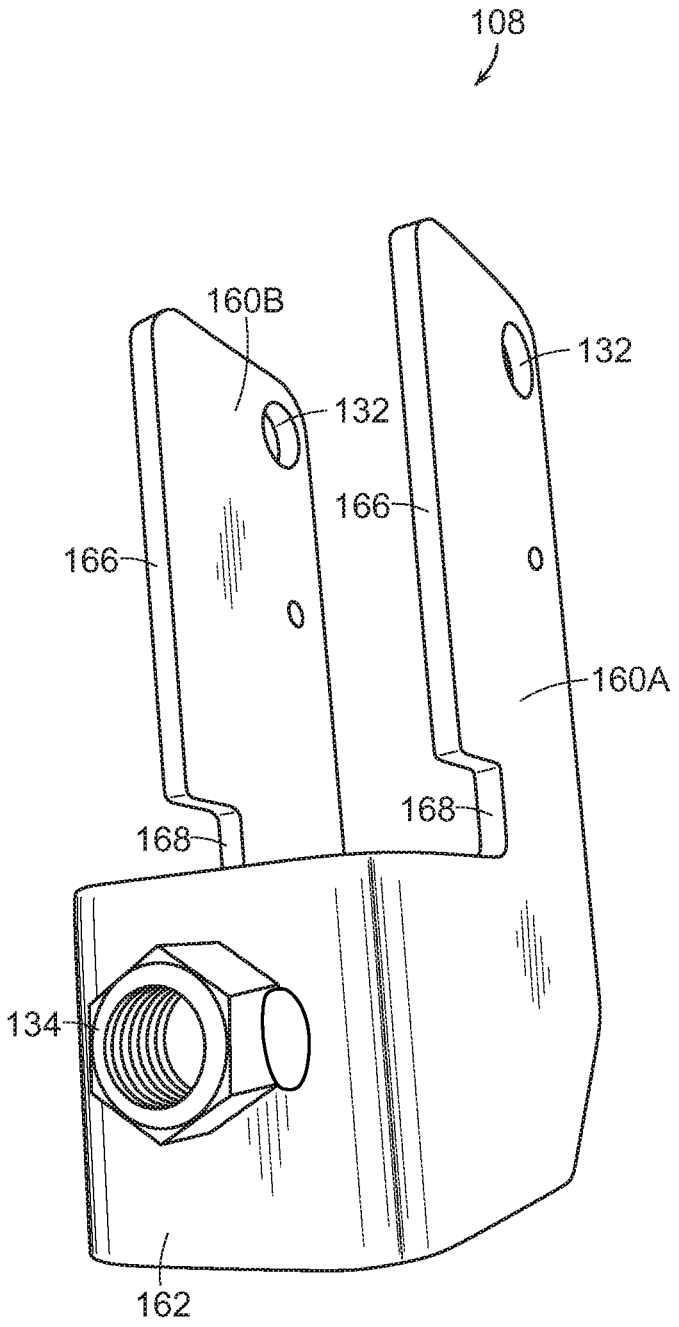
FIG. 3B is an isometric front view illustrating the pivot bracket in FIG. 3A of the support system, in accordance with an aspect of the disclosure.

Unlike previously utilized support systems, the support system 100 as disclosed herein includes a pivot bracket 108. FIGS. 3A and 3B are different views illustrating the pivot bracket 108 of the support system 100, in accordance with an aspect of the disclosure. The pivot bracket 108 may include a cam surface 136 and/or a rotational coupling 132. In some aspects, the pivot bracket also includes a receptacle 134. In some aspects, the receptacle 134 is a nut or opening for receiving the force application mechanism 112. For example, the receptacle 134 may be a weld nut, a flange nut, a T-nut, a notch, etc. In other aspects, the pivot bracket 108 does not include a receptacle 134. In these aspects, for example, a surface on the pivot bracket 108 may engage or interact with the force application mechanism 112 to receive a load from actuation of the force application of the force application mechanism 112.

In some aspects, the pivot bracket 108 includes two parallel sides 160A, 160B that extend from a front face 162. The parallel sides 160A and 160B may be mirror copies of each other. In some aspects, the front face 162 includes the receptacle 134. The receptacle 134 may be threaded to receive the force application mechanism 112. In other aspects, as discussed above, the pivot bracket 108 does not include a receptacle 134.

Each of the two parallel sides 160A and 160B may include a cam surface 136 and the rotational coupling 132 or apertures for receiving a pivot pin or bolt 138 or any other suitable attachment mechanism for the rotational coupling. The cam surfaces 136 are on the back surface 164 of the pivot bracket 108 and may be on a side opposite the front face 162. In some aspects, each of the parallel sides 160A and 160B is L-shaped as illustrated in FIG. 3A. In some aspects, the font edges 166 of the parallel sides 160A include a notch 168.

The pivot bracket 108 is coupled to the second floor 120. In some aspects, the pivot bracket 108 is directly attached to the floor 120 utilizing the rotational coupling 132. In further aspects, the pivot bracket 108 is directly attached to a floor support structure 122, such as a joist 124, of the second floor 120. In some aspects, the pivot bracket 108 is directly attached to a floor support structure 122, such as a joist 124, and an insert block 116. In other aspects, the pivot bracket 108 is indirectly attached to the floor 120. In further aspects, the pivot bracket 108 is indirectly attached to a floor support structure 122, such as a joist 124, of the second floor 120. For example, in some aspects, the pivot bracket 108 may be directly attached to the block inserts 116 for indirect attachment to the floor 120. In another example, the pivot bracket 108 is directly attached to a connector and/or another bracket for indirect attachment to the floor support structure of the second floor 120.

Figure 4:
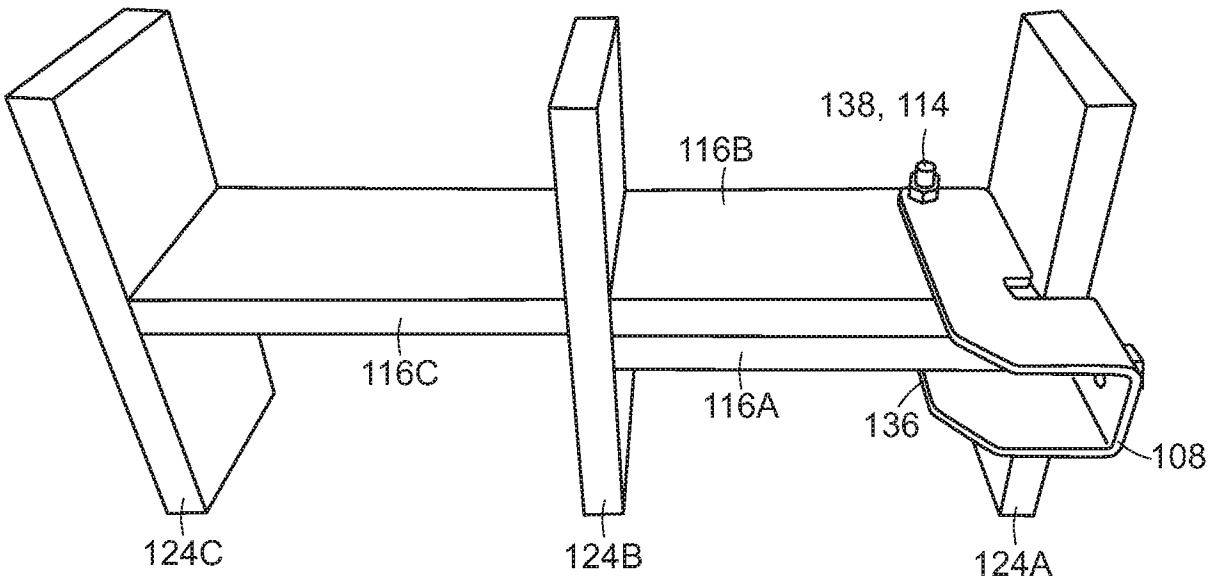
FIG. 4 is a bottom view of the pivot bracket attached to a replica floor support structure with block inserts, in accordance with an aspect of the disclosure.

FIG. 4 is a bottom view of the pivot bracket 108 attached to a replica floor support structure 122 with block inserts 116. In this replica, the model joists 124 represent the underside of the floor 120. In this replica, two blocks inserts 116A and 116B are positioned lengthwise and side-by-side between and attached to the first floor joist 124A and second floor joists 124B and a third insert block 116C is positioned between and attached to the second floor joist 124B and a third floor joist 124C. The replica shown in FIG. 4 illustrates floor joists 124 that would run parallel to wall 102 and block inserts 116 that run perpendicular to wall 102.

Figure 5B:
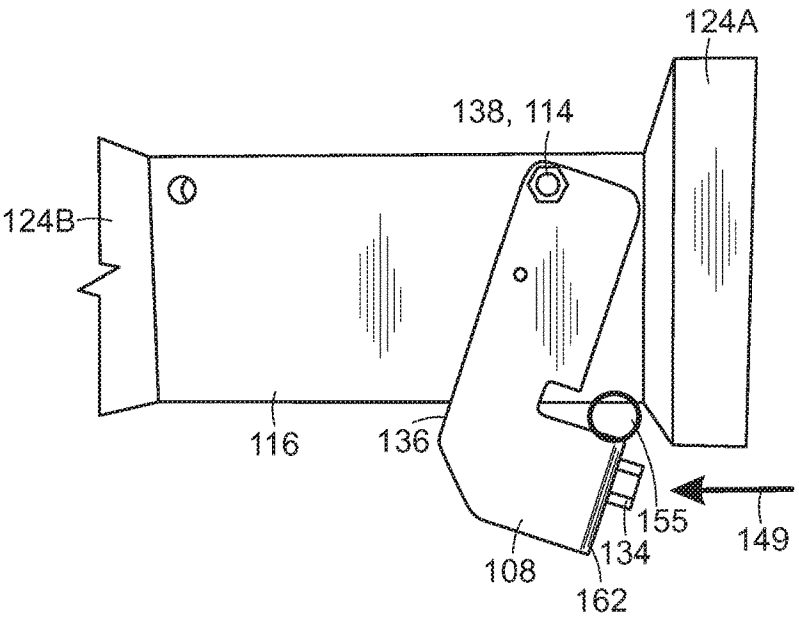
FIG. 5B is a schematic diagram illustrating a side view of the pivot bracket attached to the replica floor support structure from FIG. 5A showing a gap created under the front surface of the pivot bracket formed in response to the application of the directional force on the pivot bracket, in accordance with an aspect of the disclosure.
Figure 5A:
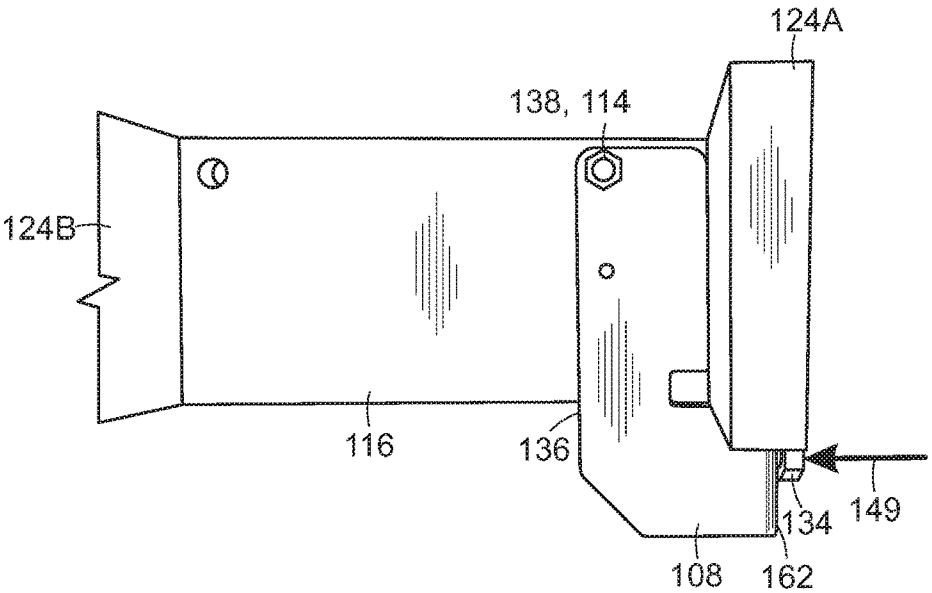
FIG. 5A is a schematic diagram illustrating a side view of a pivot bracket attached to a replica floor support structure with block inserts showing an application of directional force to the pivot bracket, in accordance with an aspect of the disclosure.

The rotational coupling 132 is utilized to couple the pivot bracket 108 to the floor 120 via an attachment mechanism, such as a bolt or pin 138. The bolt or pin 138 may be threaded or partially threaded. The rotational coupling 132 allows the pivot bracket 108 to rotate around the attachment mechanism 114. The force application mechanism 112 is positioned to interact with pivot bracket 108 and to engage the beam 104. In some aspects, the force application mechanism interacts with the front face 162 of the pivot bracket 108. Accordingly, upon actuation of the force application mechanism 112, the force application mechanism 112 applies a force to the second end of the beam 104. This force pushes the beam 104 towards the building wall 102 and a directional force 149 (shown as an arrow) is exerted upon the pivot bracket 108 as illustrated in FIGS. 5A and 5B. FIG. 5A is schematic diagram illustrating a side view of a pivot bracket 108 attached to a replica floor support structure with block inserts 116 showing an application of directional force 149 to the pivot bracket 108, in accordance with an aspect of the disclosure. FIG. 5B is a schematic diagram illustrating a side view of the pivot bracket 108 attached to the replica floor support structure with block inserts 116 from FIG. 5A showing a gap 155 created under the front surface 162 of the pivot bracket 108 created formed in response to the application of directional force 149 to the pivot bracket, in accordance with an aspect of the disclosure. This force 149 may cause the pivot bracket 108 to pivot or rotate around the attachment mechanism 114 in the rotational coupling 132 of the pivot bracket 108 in a direction that causes the pivot bracket 108 to push against, engage, or mechanically engage the installed plate 115.

Figure 6:
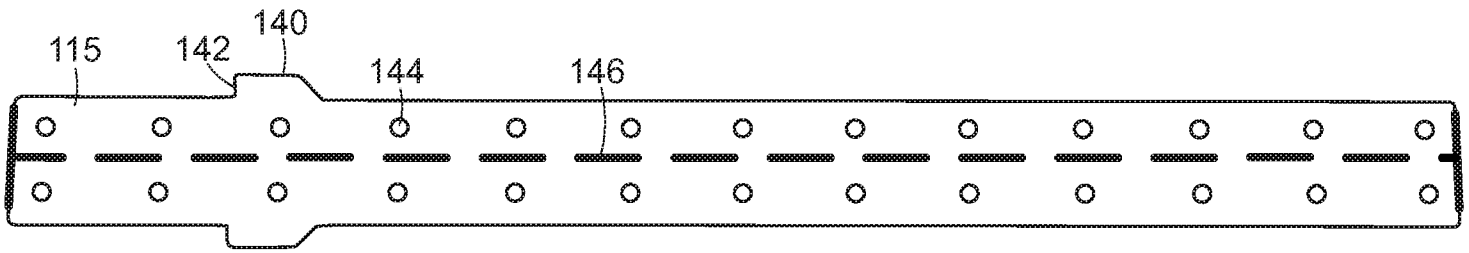
FIG. 6 is a bottom view illustrating an example plate for a support system, in accordance with an aspect of the disclosure.
Figure 7:
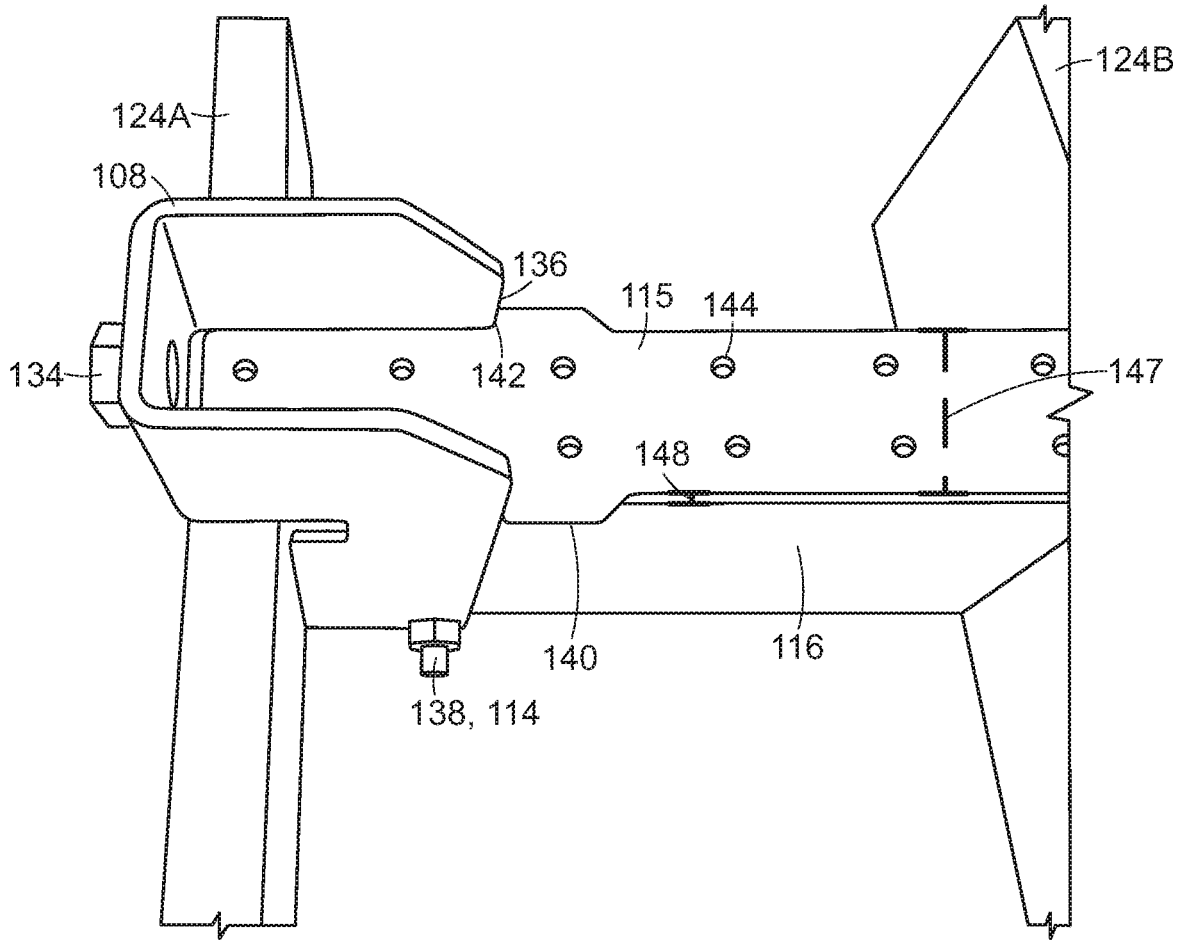
FIG. 7 is a partial bottom view illustrating a pivot bracket rotationally coupled to replica block inserts and engaged with a plate directly attached to replica first and second floor joists, in accordance with aspects of disclosure.

The support system 100 also includes a plate 115. FIG. 6 is a bottom view illustrating an example plate 115 for support system 100, in accordance with aspects of the disclosure. The plate 115 is coupled directly or indirectly to the floor 120. The plate 115 is positioned to mechanically link with a cam surface 136 of the pivot bracket 108 as illustrate by FIG. 7. FIG. 7 is a bottom view illustrating a pivot bracket 108 rotationally coupled to replica block inserts 116 and engaged with plate 115 directly attached to replica first and second floor joists 124, in accordance with aspects of disclosure. The plate 115 includes a follower surface 142 that interacts with cam surface 136 of the pivot bracket 108. The follower surface 142 is contacted by the cam surface 136 as a force 149 applied from the force application mechanism 112 rotates the pivot bracket 108. The cam surface 136 pushes against and/or slides along the follower surface 142 of the plate 115. In some aspects, the follower surface 142 is a surface created by tabs 140 or wings on the plate 115. The tabs 140 may be mirror opposites of each other. The tabs 140 may allow the plate 115 to consistently bear on the pivot bracket 108 as the pivot bracket 108 rotates even if there is some construction tolerance. Further, the tabs 140 may allow for easier and/or fast installation of the plate 115. The pivoting action of the pivot bracket 108 puts a direct compression load on the plate 115 as the pivot bracket 108 bears on the follower surface 142 of the plate 115. As such, no or very little moment is induced on the plate 115 and/or the support structure 122 of the floor 120. Accordingly, the support system 100 induces less moment on the support structure 122 of the floor 120 when compared to previously utilized systems that did not include a pivot bracket 108.

Once positioned, the plate 115 may be directly or indirectly coupled to the floor 120 utilizing an attachment mechanism 114, such as screws, nails, anchors, etc. The attachment mechanism 114 may extend through the plate 115 via attachment apertures 144. The attachment apertures 144 may be spaced across the length 146 of the plate 115. In other aspects, the attachment apertures 144 may be spaced across a portion of the plate 115. In some aspects, the plate 115 is directly attached to the floor support structure 122 of floor 120, such as to a first and second joist 124. In other aspects, the plate 115 is directly attached to the block inserts 116, which are directly attached to the support structure 122 of floor 120, such as to a first and second joist 124. In further aspects, the plate 115 is directly or indirectly attached to one or more block inserts 116 and/or to one or more floor joists 124.

In some aspects, the plate 115 is configured to have a length 146 that spans or extends past at least two floor joists 124 or at least two block inserts 116 positioned between at least one different floor joist. In some aspects, the plate 115 is elongated and extends across multiple floor joists 124 and/or block inserts 116.

Figure 8:
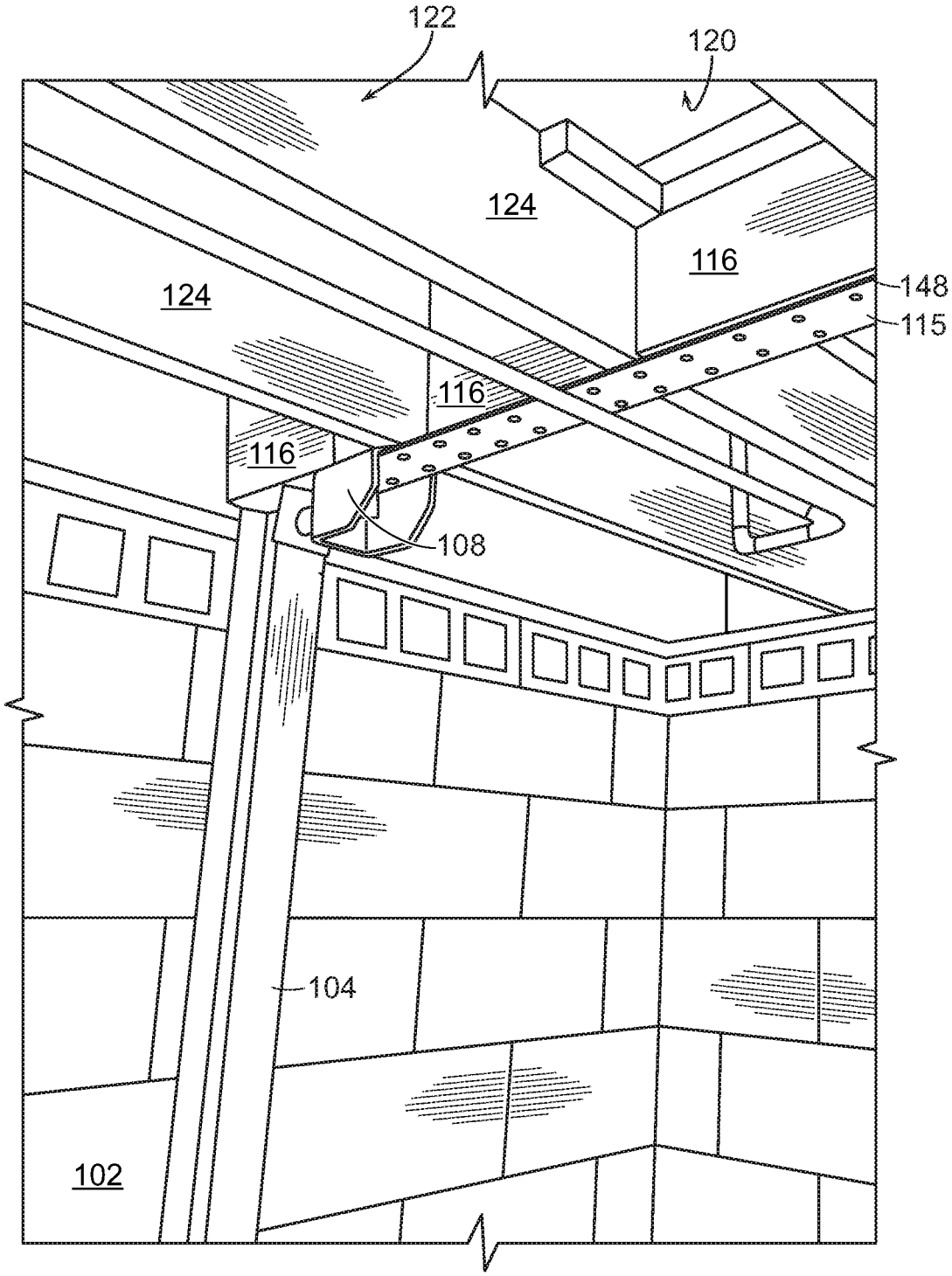
FIG. 8 is a partial, isometric view illustrating an example of an installed support system for supporting and/or straightening a building wall, in accordance with aspects of the disclosure.

Further, because the pivot bracket 108 applies the load to the plate 115 by means of tangential contact due to rotation, the depth 148 of the plate 115 can be minimized to prevent any significant impact on height clearance of the upper floor hanging structure. As such, the plate 115 may also be configured to have a depth 148 from $1/16^{th}$ of an inch to ½ inch. However, any suitable depth 148 for the plate 115 for use with the support system 100 may be utilized. Further, the plate 115 may have any suitable size or shape. For example, the width 147 of the plate 115 may extend across the width of two insert blocks 116 that are positioned lengthwise and side-by-side. In another example, the width 147 of the plate 115 may extend across the width of an insert blocks 116 and an adjacent floor joist 124. In other examples, the plate 115 may have a width that is less than one or more adjacent floor joists 124 and/or block inserts 116. FIG. 8 is a picture illustrating an example of an installed support system 100, in accordance with aspects of the disclosure. In some aspects, the plate 115 may have a width 147 from 1 inch to 4 inches. However, any suitable width 147 for the plate 115 for use with the support system 100 may be utilized.

Figure 9:
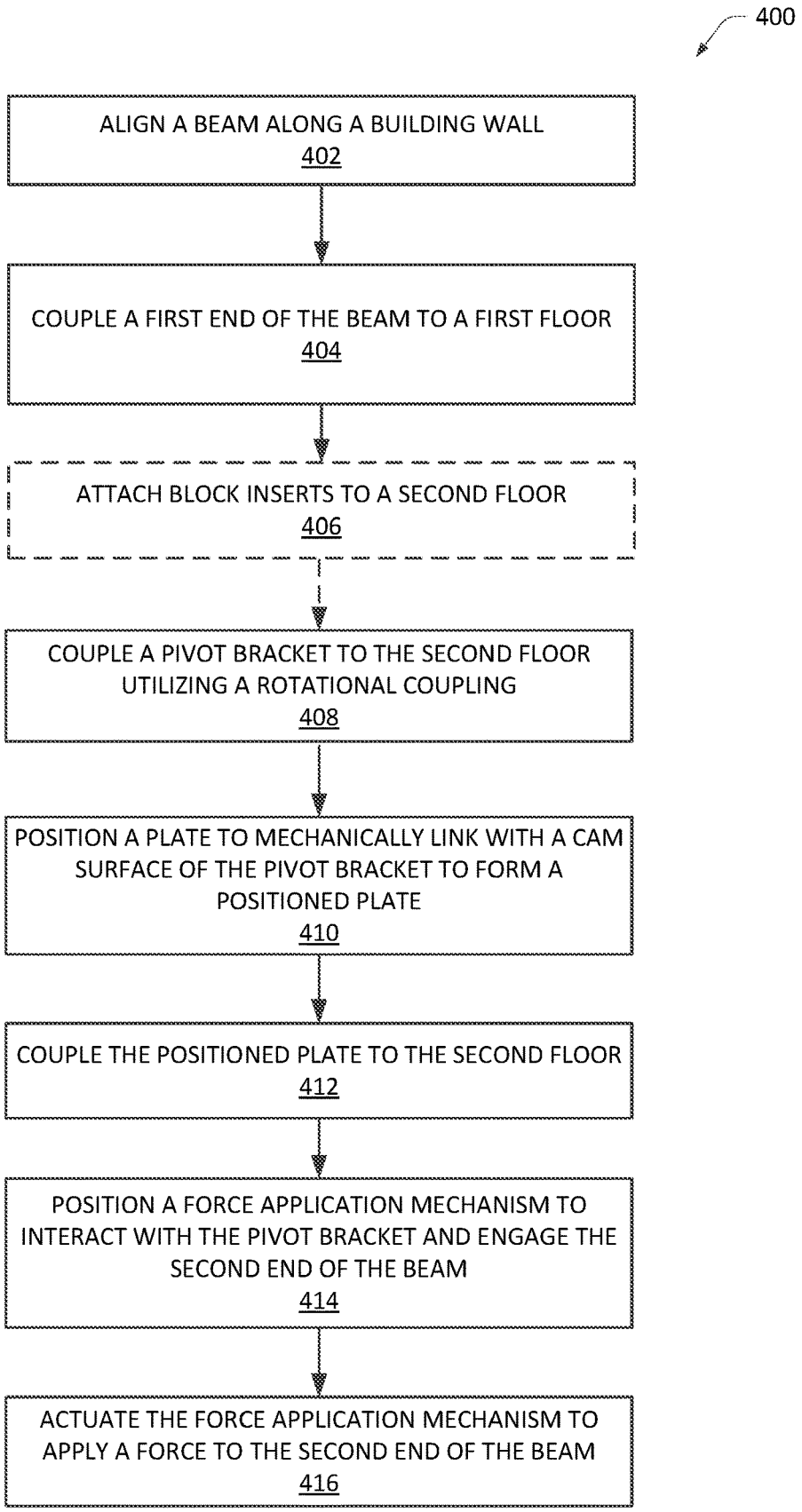
FIG. 9 is a flow diagram illustrating a method for supporting and/or straightening a wall, in accordance with an aspect of the disclosure.

FIG. 9 is a flow diagram illustrating a method 400 for supporting and/or straightening a wall. Method 400 supports and/or straightens a leaning or bowed wall by applying a direct compression load to the distribution member. Method 400 utilizes a pivot bracket and/or a plate. In some aspect, method 400 utilizes a pivot bracket and/or a plate for a direct transfer of the load to the distribution member, which spreads the load to the rest of the floor structure.

Method 400 begins at operation 402. At operation 402, a beam is aligned with a building wall that needs support and/or straightening between a first floor and a second floor. The beam includes a first end and a second end. In some aspects, the second end of the beam includes an integral holding bracket. In other aspects, a holding bracket is attached to the second end of the beam utilizing an attachment mechanism, such as being welded or bolted to the second end of the beam. In further aspects, the second end of the beam does not include a holding bracket. The second end of the beam may or may not be coupled to the second floor. In further aspects, the second end of the beam is positioned to engage, contact or mechanical engage with a force application mechanism.

Method 400 also includes operation 404. At operation 404, the first end of the beam is coupled to a first floor. In some aspects, the first end may be coupled to the first floor utilizing a base bracket and an attachment mechanism at operation 404. For example, the beam is bolted to the bracket and the base bracket is bolted to the first floor. In other examples, the base bracket is an integral part of the beam. In other aspects, the first end may be coupled to the first floor by embedding the first end of the beam into the first floor.

In some aspects, method 400 includes operation 406. At operation 406, one or more block inserts are attached to a second floor. In some aspects, the second floor includes a floor support structure, such as joists. In these aspects, the block inserts may be positioned in the floor support structure and directly or indirectly coupled to the floor support structure utilizing one or more attachment mechanisms.

At operation 408, a pivot bracket is coupled to a second floor utilizing a rotational coupling. The pivot bracket may include a cam surface and/or a rotational coupling. In some aspects, the pivot bracket also includes a receptacle. In some aspects, the pivot bracket is coupled to the floor support structure of the second floor at operation 408. In some aspects, the pivot bracket is directly attached to the floor support structure at operation 408. In other aspects, the pivot bracket is indirectly attached to the floor support structure by being directly attached to one or more block inserts at operation 408. In other aspects, the pivot bracket is directly attached to both a floor support structure of the floor and one more block inserts.

At operation 410, a plate is positioned to mechanically link with a cam surface of the pivot bracket to form a positioned plate. Next, at operation 412, the positioned plate is coupled directly or indirectly to the second floor. The plate may be coupled to the second floor utilizing an attachment mechanism. In some aspects, the plate is coupled to a floor support structure of the second floor at operation 412. In some aspects, the plate is directly attached to the floor support structure at operation 412. In other aspects, the plate is indirectly attached to the floor support structure by being directly attached to a plurality of insert blocks at operation 412. In some aspects, if the plate is attached to the floor support structure, the pivot bracket is attached to an insert block. In other aspects, if the plate is attached to a plurality of insert blocks, the pivot bracket is attached to the floor support structure.

Next, method 400 includes operation 414. At operation 414, a force application mechanism is positioned to interact with the pivot bracket and engage the second end of the beam. For example, in some aspects at operation 414, the force application mechanism is inserted through a receptacle of the pivot bracket until the force application mechanism couples, abuts, engages, or mechanically engages with the second end of the beam. In other aspects, the force application mechanism abuts, engages or mechanically engages, and/or contacts a surface of the pivot bracket, such as the front face of the pivot bracket, at one end and is applied or extended until the other end of the force application mechanism engages the second end of the beam. In some aspects, the force application system is received by a structure, such as bolt receptacle or notch, on the second end of the beam or on a holding bracket attached to a second end of the beam.

In other aspects, the force application mechanism abuts, engages, and/or contacts a surface of the second end of the beam.

After operation 414, operation 416 is performed. At operation 416, the force application mechanism is actuated (e.g., loaded, rotated, tightened, positioned and/or extended) to apply a force to the second end of the beam. The force application mechanism may be loaded, rotated, tightened, positioned and/or extended until the second end of the beam is pushed up against the building wall at operation 414. In other aspects, the force application mechanism is loaded, rotated, tightened, positioned and/or extended to push the second end of the beam closer to the building wall at operation 414. In these aspects, the force application mechanism may be further loaded, rotated, tightened, positioned and/or extended after a predetermined amount of time to push the second end of the beam closer to the building wall at operation 414. As the force application mechanism is actuated, the force application mechanism applies a force on the beam and the pivot bracket. This application of force on the pivot bracket causes the pivot bracket to rotate and to abut, couple, engage, or mechanically engage or interact with the positioned plate. The pivoting action of the pivot bracket puts a direct compression load on the plate as the pivot bracket bears on the follower surface of the plate. As such, no or very little moment is induced on the plate and/or the support structure of the floor. Accordingly, the method 400 induces less moment on the support structure of the floor when compared to previously utilized systems that did not include a pivot bracket. Further, method 400 provides for a direct transfer of the load to the distribution member by utilizing the pivot bracket and/or plate, which spread the load to the rest of the floor structure.

Aspects of the present disclosure, for example, are described above with reference to block diagrams and/or operational illustrations of methods and systems, according to aspects of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved. For example, operations 402, 406, and/or 408 may be performed in any order, at overlapping times, or simultaneously. In a further example, operations 410 and 412 could be performed before operation 408. In this example, the pivot bracket is positioned to ensure that a mechanical link is formed between the pivot bracket and the positioned plate during method 400. In another example, operations 402 and 404 could be the last operations performed during method 400.

This disclosure described some aspects of the present technology with reference to the accompanying drawings, in which only some of the possible aspects were described. Other aspects can, however, be embodied in many different forms and the specific aspects disclosed herein should not be construed as limited to the various aspects of the disclosure set forth herein. Rather, these exemplary aspects were provided so that this disclosure was thorough and complete and fully conveyed the scope of the other possible aspects to those skilled in the art. For example, aspects of the various aspects disclosed herein may be modified and/or combined without departing from the scope of this disclosure.

The description and illustration of one or more aspects provided in this application are not intended to limit or restrict the scope of the disclosure as claimed in any way. The embodiments, examples, and details provided in this application are considered sufficient to convey possession and enable others to make and use the best mode of claimed disclosure. The claims should not be construed as being limited to any embodiment, example, aspect, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A support system comprising:

a beam with a first end and a second end, the beam configured to support a building wall located between a first floor and a second floor; wherein the first end of the beam is configured to couple to the first floor;

a pivot bracket including a cam surface and a rotational coupling, the pivot bracket configured to pivotably couple to a floor support structure of the second floor utilizing the rotational coupling;

a force application mechanism interacts with the pivot bracket and engages the second end of the beam; and a plate configured to couple to the floor support structure of the second floor and positioned to mechanically link with the cam surface of the pivot bracket, wherein the force application mechanism applies force to the pivot bracket and causes the pivot bracket to rotate, pivoting action of the pivot bracket causes the cam surface of the pivot bracket to put a direct compression load on a follower surface of the plate.

2. The support system of claim 1, wherein the plate configured to couple to the floor support structure of the second floor comprises:

a direct attachment of the plate to a floor joist.

3. The support system of claim 1, further comprising:

one or more block inserts coupled to the plate.

4. The support system of claim 3, wherein the plate configured to couple to the floor support structure of the second floor comprises:

a direct attachment of the plate to a first block insert of the one or more block inserts.

5. The support system of claim 3, wherein the pivot bracket is configured to pivotably couple to the floor support structure of the second floor utilizing the rotational coupling comprises:

a direct attachment of the rotational coupling to a first block insert of the one or more block inserts.

6. The support system of claim 1, wherein the pivot bracket configured to pivotably couple to the floor support structure of the second floor utilizing the rotational coupling comprises:

a direct attachment of the rotational coupling to the floor support structure.

7. The support system of claim 1, wherein the pivot bracket configured to pivotably couple to the floor support structure of the second floor utilizing the rotational coupling comprises:

a direct attachment of the rotational coupling to a first floor joist of the floor support structure.

8. The support system of claim 1, further comprising:

one or more block inserts configured to be inserted between and attached to a first floor joist and a second floor joist of the floor support structure.

9. The support system of claim 8, wherein the pivot bracket configured to pivotably couple to the floor support structure of the second floor utilizing the rotational coupling comprises:

a direct attachment of the rotational coupling to the one or more block inserts.

10. The support system of claim 1, further comprising: a block insert adjacent to a floor joist of the floor support structure, and wherein the pivot bracket configured to pivotably couple to the floor support structure of the second floor utilizing the rotational coupling comprises:

a direct attachment of the rotational coupling to the block insert and to the floor joist.

11. The support system of claim 1, wherein a pivot bracket further includes a receptacle, and wherein the receptacle of the pivot bracket receives the force application mechanism.

12. The support system of claim 1, wherein the plate has a depth from 1/16.sup.th to ½ inches.

13. The support system of claim 1, wherein the plate has a width of 1 to 4 inches.

14. The support system of claim 1, wherein the first end of the beam is coupled to the first floor utilizing a base bracket and an attachment mechanism.

15. The support system of claim 1, wherein the first end of the beam is coupled to the first floor by embedding the first end of the beam into a hole in the first floor.

16. The support system of claim 1, further comprising:

a holding bracket, the holding bracket attached to the second end of the beam, wherein the holding bracket includes a structure for receiving an end of the force application mechanism.

17. A support system comprising:

a beam with a first end and a second end;

a pivot bracket including a receptacle, a cam surface, and a rotational coupling;

a force application mechanism placed through the receptacle of the pivot bracket until the force application mechanism engages with the second end of the beam; and a plate positioned to mechanically link with the cam surface of the pivot bracket, wherein the force application mechanism applies force to the pivot bracket and causes the pivot bracket to rotate, pivoting action of the pivot bracket causes the cam surface of the pivot bracket to put a direct compression load on a follower surface of the plate.

18. The method of claim 17, further comprising:

one or more block inserts attached to at least one of the plate and the pivot bracket.

* * * * *